US009790457B2

(12) United States Patent
Hulse et al.

(10) Patent No.: US 9,790,457 B2
(45) **Date of Patent: *Oct. 17, 2017**

(54) CLEANING COMPOSITIONS AND METHODS

(71) Applicant: HONEYWELL INTERNATIONAL INC., Morris Plains, NJ (US)

(72) Inventors: Ryan Hulse, Getzville, NY (US); Kane D Cook, Eggertsville, NY (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/374,075

(22) Filed: Dec. 9, 2016

(65) Prior Publication Data

US 2017/0088801 A1 Mar. 30, 2017

Related U.S. Application Data

(62) Division of application No. 14/618,085, filed on Feb. 10, 2015, now Pat. No. 9,550,967, which is a division of application No. 14/193,972, filed on Feb. 28, 2014, now Pat. No. 8,951,358.

(60) Provisional application No. 61/798,672, filed on Mar. 15, 2013.

(51) Int. Cl.

| | |
|---|---|
| ***B08B 3/00*** | (2006.01) |
| ***C11D 11/00*** | (2006.01) |
| ***C11D 7/50*** | (2006.01) |
| ***C11D 3/24*** | (2006.01) |
| ***C11D 7/30*** | (2006.01) |
| ***B08B 3/02*** | (2006.01) |
| ***B08B 3/08*** | (2006.01) |
| ***B08B 5/00*** | (2006.01) |
| *B08B 3/04* | (2006.01) |

(52) U.S. Cl.

CPC ..... *C11D 11/0041* (2013.01); *B08B 3/02* (2013.01); *B08B 3/08* (2013.01); *B08B 5/00* (2013.01); *C11D 3/245* (2013.01); *C11D 7/30* (2013.01); *C11D 7/5018* (2013.01); *C11D 7/5022* (2013.01); *C11D 11/0029* (2013.01); *B08B 3/00* (2013.01); *B08B 3/04* (2013.01)

(58) Field of Classification Search

CPC .... B08B 5/00; B08B 3/00; B08B 3/04; B08B 3/02; C11D 3/245; C11D 7/30; C11D 7/5018; C11D 11/0041; C23G 5/02825

See application file for complete search history.

(56) References Cited

U.S. PATENT DOCUMENTS

| | | | |
|---|---|---|---|
| 7,674,756 | B2 | 3/2010 | Johnson et al. |
| 7,985,299 | B2 | 7/2011 | Johnson et al. |
| 8,044,015 | B2 | 10/2011 | Johnson et al. |
| 8,618,040 | B2 | 12/2013 | Johnson et al. |
| 8,951,358 | B2 | 2/2015 | Hulse et al. |
| 2009/0318323 | A1 | 12/2009 | Johnson et al. |
| 2012/0004299 | A1 | 1/2012 | Hulse et al. |
| 2013/0037058 | A1 | 2/2013 | Abbas |
| 2013/0090280 | A1 | 4/2013 | Basu et al. |
| 2013/0165363 | A1 | 6/2013 | Decaire et al. |
| 2013/0228714 | A1 | 9/2013 | Johnson et al. |
| 2014/0070129 | A1 | 3/2014 | Kennoy et al. |
| 2014/0206589 | A1 | 7/2014 | Cook et al. |
| 2014/0261565 | A1 | 9/2014 | Hulse et al. |

FOREIGN PATENT DOCUMENTS

| | | | |
|---|---|---|---|
| WO | 2013043425 | A1 | 3/2013 |

*Primary Examiner* — Bibi Carrillo

(74) *Attorney, Agent, or Firm* — Colleen D. Szuch

(57) ABSTRACT

The present invention relates, in part, to cleaning methods and solvent cleaning compositions including at least one hydrofluoro-olefin or hydrochlorofluoro-olefin solvent for use in connection with cleaning of metal parts, and in certain preferred embodiments cleaning metal parts to be used in an aircraft.

18 Claims, No Drawings

CLEANING COMPOSITIONS AND METHODS

CROSS REFERENCE TO RELATED APPLICATIONS

The present application is a division of U.S. application Ser. No. 14/618,085, filed Feb. 10, 2015, now U.S. Pat. No. 9,550,967, which is a division of U.S. application Ser. No. 14/193,972, filed Feb. 28, 2014, (now U.S. Pat. No. 8,951,358, issued Feb. 10, 2015) which application is related to and claims the priority benefit of U.S. Provisional Application 61/798,672, filed Mar. 15, 2013, which is incorporated herein by reference in its entirety.

FIELD OF THE INVENTION

The present invention relates to compositions and methods for removing soils from titanium-containing metal parts and parts comprised of certain other metals and alloys thereof.

BACKGROUND OF THE INVENTION

Effective cleaning compositions and cleaning methods for use in connection with certain metal parts, and in particular with metal parts used in high stress and/or high criticality applications are frequently difficult to identify. For example, certain critical metal components used in the engines of an aircraft are formed from titanium or alloys comprising titanium. Such parts are not only typically subject to high levels of stress and/or strain, they are also critical components in the sense of having a potentially direct impact on the safety and/or reliability of the aircraft. Other metals and metal alloys, including those described hereinafter, are frequently used in similar situations and are also difficult to effectively and safely clean.

With respect to the safety of the cleaning composition and the cleaning method, one of the concerns that is relevant to the identification of such compositions and methods is the possibility of causing an unacceptable change in one or more of the important properties of the metal. For example, cleaning compositions and methods which are used to remove soils from titanium parts used in aircraft, and in particular in aircraft jet engines, must not undergo any substantial increase in embrittlement as a result of being exposed to the cleaning composition or the cleaning methods. Heretofor it has been generally accepted that halogenated solvents should not be used to remove soil from such metal parts because of the unacceptable tendency of the heretofore used halogenated compounds to cause an increase in the brittleness of the titanium. Because of the critical applications of these metal parts, even a relatively small increase in the brittleness of the metal is unacceptable.

Accordingly, applicants have come to recognize a need for new cleaning solvents and cleaning methods that are effective to remove residue from certain parts formed from metals and metal alloys without negatively affecting one or more of the important properties the metal, including in particular, without negatively affecting the brittleness of the metal.

SUMMARY

In one aspect, the present invention relates to methods of cleaning metal parts formed from metal or metal alloys comprising providing a solvent composition comprising at least one HCFO having three (3) carbon atoms and contacting the metal part with the solvent composition under conditions effective to remove one or more of the soils contained thereon. As used herein, the term HFCO refers to a compound that has at least one hydrogen, at least one chlorine and at least one fluorine substituent.

In certain embodiments, the HCFO has the structure of formula (I):

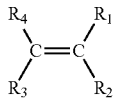

wherein $R_1$, $R_2$ $R_3$, and $R_4$ are each independently selected from the group consisting of: H, F, Cl, and substituted or unsubstituted $C_1$ alkyl. In certain highly preferred embodiments, the solvent composition comprises, and even more preferably comprises at least about 50% by weight, and even more preferably comprises at least about 75% by weight of HCFO-1233, and even more preferably 1-chloro-3,3,3-trifluoropropene (HCFO-1233zd). The solvent composition may include, in addition to the HCFO, one or more co-agents, including cosolvents, which are preferably miscible therewith under the conditions of use. In certain preferred embodiments, such co-agent is present and includes one or more alcohols, and even more preferably one or more C1 or C2 alcohols.

In one aspect of the invention, the present solvent compositions are used in methods for cleaning metal parts comprising the steps of contacting at least a portion or surface of the metal part with a solvent composition according to the present invention in an amount effective to remove the desired amount and type of contaminant from the metal part, including by solvating said contaminant and removing same by removing at least a portion of the solvent composition from the metal part.

The parts which are preferably cleaned using the methods and compositions of the present invention comprise, at least in part, metals and metal alloy selected from: titanium and titanium alloys; zinc and zinc alloys, including preferably high zinc alloys such as aluminum; tungsten and tungsten/alloys, including preferably tungsten carbide; copper and copper alloys, including preferably high copper alloys, such as aluminum; Inconel-Ni alloys; silver and silver alloys, including silver braze alloys; cadmium and cadmium alloys, including preferably cadmium plated components and parts; stainless steels, including preferably 440C stainless steel.

According to certain preferred embodiments, one aluminum alloy which is exemplary of a metal alloy that can be treated in accordance with the present invention is known by the designation 2024-T3, the composition of which is described below:

2024-T3

| Component | Wt % |
|---|---|
| Al | 90.7-94.7 |
| Cr | Max 0.1 |
| Cu | 3.8-4.9 |
| Fe | Max 0.5 |
| Mg | 1.2-1.8 |
| Mn | 0.3-0.9 |
| Si | Max 0.5 |
| Ti | Max 0.15 |
| Zn | Max 0.25 |

According to certain preferred embodiments, one aluminum alloy which is exemplary of a metal alloy that can be treated in accordance with the present invention is known by the designation 7075-T6, the composition of which is described below:

7075-T6

| Component | Wt % |
|---|---|
| Al | 87.1-91.4 |
| Cr | 0.18-0.28 |
| Cu | 1.2-2 |
| Fe | Max 0.5 |
| Mg | 2.1-2.9 |
| Mn | Max 0.3 |
| Si | Max 0.4 |
| Ti | Max 0.2 |
| Zn | 5.1-6.1 |

According to certain preferred embodiments, one titanium alloy which is exemplary of a metal alloy that can be treated in accordance with the present invention is known by the designation 6A1-4V, the composition of which is described below:

6A1-4V

| Component | Wt % |
|---|---|
| Al | 6 |
| Fe | Max 0.25 |
| O | Max 0.2 |
| Ti | 90 |
| V | 4 |

According to certain preferred embodiments, one magnesium alloy which is exemplary of a metal alloy that can be treated in accordance with the present invention is known by the designation AZ31B-H24, the composition of which is described below:

AZ31B-H24

| Component | Wt % |
|---|---|
| Al | 3 |
| Mg | 96 |
| Zn | 1 |

Additional advantages and embodiments will be readily apparent to one of skill in the art, based on the disclosure provided herein.

DETAILED DESCRIPTION OF PREFERRED EMBODIMENTS

For purposes of the present invention, an HCFO may be any hydrohalocarbon with chlorine and fluorine atoms attached to any of the carbons and any one of the carbon-carbon bonds being a double bond. Similarly, an HFO is any hydrohalocarbon with fluorine atoms attached to any of the carbons and any one of the carbon-carbon bonds being a double bond.

In certain aspects, the HCFO and HFO solvents of the present invention include one or more C2 to C6 fluoroalkenes or one or more C3, C4, or C5 fluoroalkenes, which may be generically represented by Formula B as follows:

$$XCF_zR_{3-z} \quad (B)$$

where X is a $C_2$, $C_3$, $C_4$ or $C_5$ unsaturated, substituted or unsubstituted, radical, each R is independently Cl, F, Br, I or H, and z is 1 to 3. In certain embodiments, the fluoroalkene of the present invention has at least four (4) halogen substituents, at least three of which are F and even more preferably none of which are Br. In even further embodiments, the compound of formula B comprises a compound, and preferably a three carbon compound, in which each non-terminal unsaturated carbon has a fluorine substituent.

Suitable HCFOs and HFOs may also be represented one or more compounds having the structure of formula (I):

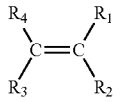

(I)

wherein $R_1$, $R_2$ $R_3$, and $R_4$ are each independently selected from the group consisting of: H, F, Cl, and $C_1$-$C_6$ alkyl, at least $C_6$ aryl, in particular $C_6$-$C_{15}$ aryl, at least $C_3$ cycloalkyl, in particular $C_6$-$C_{12}$ cycloalkyl, and $C_6$-$C_{15}$ alkylaryl, optionally substituted with at least one F or Cl wherein formula (I) contains at least one F, and preferably at least one Cl.

Suitable alkyls include, but are not limited to, methyl, ethyl, and propyl. Suitable aryls include, but are not limited to phenyl. Suitable alkylaryl include, but are not limited to methyl, ethyl, or propyl phenyl; benzyl, methyl, ethyl, or propyl benzyl, ethyl benzyl. Suitable cycloalkyls include, but are not limited to, methyl, ethyl, or propyl cyclohexyl. Typical alkyl group attached (at the ortho, para, or meta positions) to the aryl can have $C_1$-$C_7$ alkyl chain. The compounds of formula (I) are preferably linear compounds although branched compounds are not excluded.

Non-limiting examples of such a solvent compound include compounds having the formula $C_3F_3H_2Cl$ (HCFO-1233), $C_4H_2F_6$ (HFO-1336), $CF_3CF{=}CFCF_2CF_2Cl$ and $CF_3CCl{=}CFCF_2CF_3$, and mixtures thereof.

The term "HCFO-1233" or "1233" is used herein to refer to all monochloro-trifluoropropenes. Among the monochloro-trifluoropropenes included is 2-chloro-1,1,1-trifluoropropene (HCFO-1233xf) and 1-chloro-3,3,3-trifluoro-propene (HCFO-1233zd). The term HCFO-1233zd is used herein generically to refer to 1-chloro-3,3,3-trifluoropropene, independent of whether it is the cis- or trans-form. The terms "cis HCFO-1233zd" and "trans HCFO-1233zd" are used herein to describe the cis- and trans- forms of 1-chloro-3,3,3-trifluoropropene, respectively. The term "HCFO-1233zd" therefore includes within its scope cis HCFO-1233zd (also referred to as HCFO-1233zd(Z)), trans HCFO-1233zd (also referred to as HCFO-1233zd(E)), and all combinations and mixtures of these.

After extensive study, testing and analysis, applicants have determined that the performance of 1233zd(E) and 1233zd(Z) provides unexpected but highly advantageous properties when used in connection with solvent cleaning methods and in solvent compositions as described herein. Accordingly, the methods and compositions of the present invention include, in broad aspects, compositions in which a halogenated olefin consists essentially of, or preferably in certain embodiments consists of, either 1233zd(E) or 1233zd(z), and all proportions and combinations of these two isomers with respect to one another.

In certain preferred embodiments, including those in which cleaning of the part according to the present invention includes cleaning of a relatively small gaps or spaces included in or embedded in or otherwise associated with the metal part such that such cleaning requires a relatively low surface tension solvent composition, it is preferred that the composition include at least some proportion of 1233zd(E) since this material has a very low surface tension of 12.7 dynes/cm and Kauri-Butanol value of 25. As a result, it is excellent for use in applications where there is a need to penetrate narrow spaces, and thus would be able to clean under surface mounts of printed circuit boards and the like. On the other hand, 1233zd(Z) has other properties, such as and including but not limited to a boiling point and heat of vaporization, that make it attractive in many applications. Accordingly, applicants contemplate that several solvent compositions comprising both 1233zd(Z) and 1233zd(E) may be beneficial. By way of example, the concentration ranges in the following Table 1, based upon the total of 1233zd, are considered as having utility in various solvent cleaning aspects of the present invention.

TABLE 1

| Example | Relative Concentration 1233zd(Z) | Relative Concentration 1233zd(E) |
|---|---|---|
| 1 | 5 | 95 |
| 2 | 10 | 90 |
| 3 | 15 | 85 |
| 4 | 20 | 80 |
| 5 | 25 | 75 |
| 6 | 30 | 70 |
| 7 | 35 | 65 |
| 8 | 40 | 60 |
| 9 | 45 | 65 |
| 10 | 50 | 50 |
| 11 | 55 | 45 |
| 12 | 60 | 40 |
| 13 | 65 | 45 |
| 14 | 70 | 30 |
| 15 | 75 | 25 |
| 16 | 80 | 20 |
| 17 | 85 | 15 |
| 18 | 90 | 10 |
| 19 | 95 | 5 |
| 20 | 100 | 0 |
| 21 | 0 | 100 |

According to certain aspects of the invention, the solvent compositions may also include one or more co-agents or co-solvents, which may be specifically tailored for one or more of the uses provided herein. In one aspect, the co-agent/co-solvent is an alcohol, which may be provided in any effective or sufficient amount to facilitate the cleaning applications discussed herein. As used herein the terms "alcohol" or "alcohol co-solvents" include any one or combination of alcohol containing compounds that are soluble in the HFO/HCFO solvent. Such alcohols may include, in certain non-limiting embodiments, one or more straight or branched chain aliphatic carbon moieties having between 1 and 5 carbons. In further embodiments, the alcohols may include between 1 and 3 carbons. In even further embodiments, the alcohols include methanol, ethanol, isopropanol, isomers or combinations thereof.

The effective amount of alcohol may include any amount, such as the foregoing, where the solvent-alcohol compositions of the invention clean and/or displace soil from a broad range of substrates. To this end, the effective amount may vary widely depending on the application and will be readily apparent to those skilled in the art. In one aspect, the effective amount of solvent and co-solvent alcohol used may be any amount to remove dirt or debris from the surface of the substrate to be cleaned. An effective amount of alcohol is any amount that is needed for the soil repellency capability of the HCFO or HFO to any extent. By way of non-limiting example, the amount of alcohol used can be any amount between about 0.1 to about 50 weight percent or about 1 to about 30 weight percent, based on the total weight of the solvent composition.

The manner of contacting the part be cleaned in accordance with the present solvent compositions and methods can vary widely, and it is contemplated that broadly all such contacting methods and mechanisms that are known to those skilled in the art for cleaning such parts are adaptable for use in accordance with the present invention in view of the teachings contained herein. By way of example, the metal part may be immersed in a container of the composition, immersed in a vapor space containing the composition, sprayed with the composition in an aerosol or other form of spray, and any combination of these. In certain preferred embodiments which utilize a contacting step comprising spraying the cleaning composition, the spray cleaning can be done using the vapor pressure of the solvent composition as a propellant, or in the alternative and additional embodiments, a separate propellant composition or compound, such as preferably trans-1234ze can be added to assist in the spraying process. It will be appreciated that other pressurizing gases such as nitrogen or carbon dioxide could also be added to assist in the spraying of the solvent composition according to the present invention.

Complete immersion of the substrate in a liquid phase of the present composition is preferred in many embodiments because maximize the opportunity for intimate contact between all exposed surfaces of the metal part and the composition. In certain embodiments, the contacting time is from about 10 minutes to 30 minutes, but will be understood that longer or shorter times can be used depending on the particular application.

The contacting temperature may also vary widely depending on many factors associated with the particular application, including but not limited to the boiling point of the solvent composition in accordance with the present invention. In general, the temperature is equal to or less than about such boiling point. In preferred aspects of the methods according to the present invention, following the contacting step the part being cleaned is removed from contact with the solvent composition, thus affecting at least partial removal of the soil, residue or contaminant intended to be removed by the present methods.

In general, removal, or evaporation, of the composition is effected in less than about 30 seconds, preferably less than about 10 seconds. Atmospheric or sub-atmospheric pressure may be employed and temperatures above and below the boiling point of the HCFO or HFO may be used. Optionally, additional surfactants may be included in the overall composition as desired.

With respect to contaminants, it is generally contemplated that the present compositions and methods are adaptable for removing at least a portion, and in certain preferred embodiments substantially all of at least one contaminant which it is desired to remove. It is contemplated that such contaminants may include one or more of the following and can be removed, at least in part, using the solvent compositions and/or methods of the present invention: hydrochloric acid, trichlorethylene, carbon tetrachloride, chlorinated cutting oils, chlorides, freons, and methyl alcohol. In certain preferred embodiments, cutting oils and/or other oils such as mineral oils and the like, are removed at least in part, and preferably in substantial part, and even more preferably substantially entirely, using the compositions and/or methods of the present invention.

The following are examples of the invention and are not to be construed as limiting.

EXAMPLES

Examples 1-21

The ability of the present solvent compositions and cleaning methods to treat aluminum alloys, without negatively affecting at least certain of the advantageous properties thereof, is illustrated by testing solvent compositions consisting of 1233zd as disclosed in Table 1 above in accordance with ASTM F1110 Sandwich Corrosion Test on several metals as identified in Table 2 below., with the results being as indicated. According to ASTM F 1110, metal panels are sandwiched together with filter paper saturated with the test material between the panels. The sandwiched panels are cycled between warm ambient air and warm humid air for 7 days. The coupons are then inspected to determine whether corrosion more severe than that caused by a reagent water has occurred on the surfaces exposed to the test material. This test method may be used for solutions of dry granular material or for liquid materials.

TABLE 2

| Comp./ Example ↓ | Material Tested* → | A** | B** | C** | D** | E** | F** | G** |
|---|---|---|---|---|---|---|---|---|
| 1/1 | | Y | Y | Y | Y | Y | Y | Y |
| 2/2 | | Y | Y | Y | Y | Y | Y | Y |
| 3/3 | | Y | Y | Y | Y | Y | Y | Y |
| 4/4 | | Y | Y | Y | Y | Y | Y | Y |
| 5/5 | | Y | Y | Y | Y | Y | Y | Y |
| 6/6 | | Y | Y | Y | Y | Y | Y | Y |
| 7/7 | | Y | Y | Y | Y | Y | Y | Y |
| 8/8 | | Y | Y | Y | Y | Y | Y | Y |
| 9/9 | | Y | Y | Y | Y | Y | Y | Y |
| 10/10 | | Y | Y | Y | Y | Y | Y | Y |
| 11/11 | | Y | Y | Y | Y | Y | Y | Y |
| 12/12 | | Y | Y | Y | Y | Y | Y | Y |
| 13/13 | | Y | Y | Y | Y | Y | Y | Y |
| 14/14 | | Y | Y | Y | Y | Y | Y | Y |
| 15/15 | | Y | Y | Y | Y | Y | Y | Y |
| 16/16 | | Y | Y | Y | Y | Y | Y | Y |
| 17/17 | | Y | Y | Y | Y | Y | Y | Y |
| 18/18 | | Y | Y | Y | Y | Y | Y | Y |
| 19/19 | | Y | Y | Y | Y | Y | Y | Y |
| 20/20 | | Y | Y | Y | Y | Y | Y | Y |
| 21/21 | | Y | Y | Y | Y | Y | Y | Y |

*Y indicates a positive test result in conformity with ASTM F1110
**
A is Al alloy 2024-T3 Bare/Anodized per MIL-C-5541
B is Al alloy 2024-T3 Bare/Anodized per MIL-A-8625
C is Al alloy 2024-T3 Clad/Anodized per MIL-C-5541
D is Al alloy 2024-T3 Clad/Anodized per MIL-A-8625
E is Al alloy 7075-T6 Clad/Anodized per MIL-C-5541
F is Al alloy 7075-T6 Clad/Anodized per MIL-A-8625
G is Al alloy 7075-T6 Bare/Anodized per BAC 5019

Examples 22-42

The ability of the present solvent compositions and cleaning methods to treat various materials without negatively affecting at least certain of the advantageous properties thereof, is illustrated by testing solvent compositions consisting of 1233zd according to those combinations disclosed in Table 1 above in accordance with ASTM F483 Immersion Corrosion Test on the several metals as identified in Table 3 below, with the results being as indicated. According to the test provided by ASTM F483, the tested metals/alloys were completely submerged in the solvent. The alloys were then removed from the solvent and checked for weight loss and visually inspected for corrosion.

TABLE 3

| Comp./ Example ↓ | Material Tested* → | H** | I** | J** | K** | L** | M** |
|---|---|---|---|---|---|---|---|
| 1/22 | | Y | Y | Y | Y | Y | Y |
| 2/23 | | Y | Y | Y | Y | Y | Y |
| 3/24 | | Y | Y | Y | Y | Y | Y |
| 4/25 | | Y | Y | Y | Y | Y | Y |
| 5/26 | | Y | Y | Y | Y | Y | Y |
| 6/27 | | Y | Y | Y | Y | Y | Y |
| 7/28 | | Y | Y | Y | Y | Y | Y |
| 8/29 | | Y | Y | Y | Y | Y | Y |
| 9/30 | | Y | Y | Y | Y | Y | Y |
| 10/31 | | Y | Y | Y | Y | Y | Y |
| 11/32 | | Y | Y | Y | Y | Y | Y |
| 12/33 | | Y | Y | Y | Y | Y | Y |
| 13/34 | | Y | Y | Y | Y | Y | Y |
| 14/35 | | Y | Y | Y | Y | Y | Y |
| 15/36 | | Y | Y | Y | Y | Y | Y |
| 16/37 | | Y | Y | Y | Y | Y | Y |
| 17/38 | | Y | Y | Y | Y | Y | Y |
| 18/39 | | Y | Y | Y | Y | Y | Y |
| 19/40 | | Y | Y | Y | Y | Y | Y |
| 20/41 | | Y | Y | Y | Y | Y | Y |
| 21/42 | | Y | Y | Y | Y | Y | Y |

*Y indicates a positive test result in conformity with ASTM F483
**
H is Al alloy 7075-T6
I Al alloy 2024-T3
J is Titanium alloy 6A1-4V
K is Carbon Steel
L is Magnesium Alloy AZ31B-H24
M is 4130 Steel plated with low hydrogen embrittlement cadmium
G is Al alloy 7075-T6 Bare/Anodized per BAC 5019

Examples 43-63

The ability of the present solvent compositions and cleaning methods to treat titanium without negatively affecting at least certain of the advantageous properties thereof, is illustrated by testing solvent compositions consisting of 1233zd according to those combinations disclosed in Table 1 above in accordance with ASTM F945 Stress-Corrosion of Titanium, with the results being as indicated in Table 4 below. According to the test method of ASTM F945, the titanium sheet was stressed and exposed to the solvent. After the titanium sheet had been dried it was inspected for cracks according to the procedures described in ASTM F945.

TABLE 4

| Comp./ Example | Material Tested* Titanium |
|---|---|
| 1/43 | Y |
| 2/44 | Y |
| 3/45 | Y |
| 4/46 | Y |
| 5/47 | Y |
| 6/48 | Y |
| 7/49 | Y |
| 8/50 | Y |
| 9/51 | Y |
| 10/52 | Y |

TABLE 4-continued

| Comp./ Example | Material Tested* Titanium |
|---|---|
| 11/53 | Y |
| 12/54 | Y |
| 13/55 | Y |
| 14/56 | Y |
| 15/57 | Y |
| 16/58 | Y |
| 17/59 | Y |
| 18/60 | Y |
| 19/61 | Y |
| 20/62 | Y |
| 21/63 | Y |

*Y indicates a positive test result in conformity with ASTM F945

Examples 64-84

The ability of certain embodiments of the present solvent compositions and cleaning methods to effectively remove cutting oil in typical contaminant amounts found on metal parts used in the manufacture and/or repair and/or maintenance of such parts in connection with aircraft engines and/or other portions of the aircraft is illustrated by providing a coupon of each of the aluminum alloys indicated in Table 5 contaminated as indicated herein. The contaminated coupon is contacted with each composition by spraying the coupon with each of the solvent compositions consisting of 1233zd as disclosed in Table 1 above and the results as reported in Table 5 below are achieved.

TABLE 5

| Comp./ Example ↓ | Material Tested* → | A** | B** | C** | D** | E** | F** | G** |
|---|---|---|---|---|---|---|---|---|
| 1/64 | | Y | Y | Y | Y | Y | Y | Y |
| 2/65 | | Y | Y | Y | Y | Y | Y | Y |
| 3/66 | | Y | Y | Y | Y | Y | Y | Y |
| 4/67 | | Y | Y | Y | Y | Y | Y | Y |
| 5/68 | | Y | Y | Y | Y | Y | Y | Y |
| 6/69 | | Y | Y | Y | Y | Y | Y | Y |
| 7/70 | | Y | Y | Y | Y | Y | Y | Y |
| 8/71 | | Y | Y | Y | Y | Y | Y | Y |
| 9/72 | | Y | Y | Y | Y | Y | Y | Y |
| 10/73 | | Y | Y | Y | Y | Y | Y | Y |
| 11/74 | | Y | Y | Y | Y | Y | Y | Y |
| 12/75 | | Y | Y | Y | Y | Y | Y | Y |
| 13/76 | | Y | Y | Y | Y | Y | Y | Y |
| 14/77 | | Y | Y | Y | Y | Y | Y | Y |
| 15/78 | | Y | Y | Y | Y | Y | Y | Y |
| 16/79 | | Y | Y | Y | Y | Y | Y | Y |
| 17/80 | | Y | Y | Y | Y | Y | Y | Y |
| 18/81 | | Y | Y | Y | Y | Y | Y | Y |
| 19/82 | | Y | Y | Y | Y | Y | Y | Y |
| 20/83 | | Y | Y | Y | Y | Y | Y | Y |
| 21/84 | | Y | Y | Y | Y | Y | Y | Y |

*Y indicates that at least a portion of cutting oil contaminant is removed.
**
A is Al alloy 2024-T3 Bare/Anodized per MIL-C-5541
B is Al alloy 2024-T3 Bare/Anodized per MIL-A-8625
C is Al alloy 2024-T3 Clad/Anodized per MIL-C-5541
D is Al alloy 2024-T3 Clad/Anodized per MIL-A-8625
E is Al alloy 7075-T6 Clad/Anodized per MIL-C-5541
F is Al alloy 7075-T6 Clad/Anodized per MIL-A-8625
G is Al alloy 7075-T6 Bare/Anodized per BAC 5019

Examples 85-105

The ability of certain embodiments of the present solvent compositions and cleaning methods to effectively remove cutting oil in typical contaminant amounts found on metal parts used in the manufacture and/or repair and/or maintenance of such parts in connection with aircraft engines and/or other portions of the aircraft is illustrated by providing a coupon of each of the metal and metal alloys indicated in Table 6 contaminated as indicated herein. The contaminated coupon is contacted with each composition by spraying the coupon with each of the solvent compositions consisting of 1233zd as disclosed in Table 1 above and the results as reported in Table 6 below are achieved.

TABLE 6

| Comp./ Example ↓ | Material Tested* → | H** | I** | J** | K** | L** | M** | N** |
|---|---|---|---|---|---|---|---|---|
| 1/85 | | Y | Y | Y | Y | Y | Y | Y |
| 2/86 | | Y | Y | Y | Y | Y | Y | Y |
| 3/87 | | Y | Y | Y | Y | Y | Y | Y |
| 4/88 | | Y | Y | Y | Y | Y | Y | Y |
| 5/89 | | Y | Y | Y | Y | Y | Y | Y |
| 6/90 | | Y | Y | Y | Y | Y | Y | Y |
| 7/91 | | Y | Y | Y | Y | Y | Y | Y |
| 8/92 | | Y | Y | Y | Y | Y | Y | Y |
| 9/93 | | Y | Y | Y | Y | Y | Y | Y |
| 10/94 | | Y | Y | Y | Y | Y | Y | Y |
| 11/95 | | Y | Y | Y | Y | Y | Y | Y |
| 12/96 | | Y | Y | Y | Y | Y | Y | Y |
| 13/97 | | Y | Y | Y | Y | Y | Y | Y |
| 14/98 | | Y | Y | Y | Y | Y | Y | Y |
| 15/99 | | Y | Y | Y | Y | Y | Y | Y |
| 16/100 | | Y | Y | Y | Y | Y | Y | Y |
| 17/101 | | Y | Y | Y | Y | Y | Y | Y |
| 18/102 | | Y | Y | Y | Y | Y | Y | Y |
| 19/103 | | Y | Y | Y | Y | Y | Y | Y |
| 20/104 | | Y | Y | Y | Y | Y | Y | Y |
| 21/105 | | Y | Y | Y | Y | Y | Y | Y |

*Y indicates at least a portion of cutting oil contaminant is removed.
**
H is Al alloy 7075-T6
I Al alloy 2024-T3
J is Titanium alloy 6A1-4V
K is Carbon Steel
L is Magnesium Alloy AZ31B-H24
M is 4130 Steel plated with low hydrogen embrittlement cadmium
N is Titanium

Examples 106-126

The ability of certain embodiments of the present solvent compositions and cleaning methods to effectively remove cutting oil in typical contaminant amounts found on metal parts used in the manufacture and/or repair and/or maintenance of such parts in connection with aircraft engines and/or other portions of the aircraft is illustrated by providing a coupon of each of the aluminum alloys indicated in Table 7 contaminated as indicated herein. The contaminated coupon is contacted with each composition by immersing the coupon with each of the solvent compositions consisting of 1233zd as disclosed in Table 1 above and results as reported in Table 7 below are achieved.

TABLE 7

| Comp./ Example ↓ | Material Tested* → | A** | B** | C** | D** | E** | F** | G** |
|---|---|---|---|---|---|---|---|---|
| 1/106 | | Y | Y | Y | Y | Y | Y | Y |
| 2/107 | | Y | Y | Y | Y | Y | Y | Y |
| 3/108 | | Y | Y | Y | Y | Y | Y | Y |
| 4/109 | | Y | Y | Y | Y | Y | Y | Y |

TABLE 7-continued

| Comp./ Example ↓ | Material Tested* → | A** | B** | C** | D** | E** | F** | G** |
|---|---|---|---|---|---|---|---|---|
| 5/110 | | Y | Y | Y | Y | Y | Y | Y |
| 6/111 | | Y | Y | Y | Y | Y | Y | Y |
| 7/112 | | Y | Y | Y | Y | Y | Y | Y |
| 8/113 | | Y | Y | Y | Y | Y | Y | Y |
| 9/114 | | Y | Y | Y | Y | Y | Y | Y |
| 10/115 | | Y | Y | Y | Y | Y | Y | Y |
| 11/116 | | Y | Y | Y | Y | Y | Y | Y |
| 12/117 | | Y | Y | Y | Y | Y | Y | Y |
| 13/118 | | Y | Y | Y | Y | Y | Y | Y |
| 14/119 | | Y | Y | Y | Y | Y | Y | Y |
| 15/120 | | Y | Y | Y | Y | Y | Y | Y |
| 16/121 | | Y | Y | Y | Y | Y | Y | Y |
| 17/122 | | Y | Y | Y | Y | Y | Y | Y |
| 18/123 | | Y | Y | Y | Y | Y | Y | Y |
| 19/124 | | Y | Y | Y | Y | Y | Y | Y |
| 20/125 | | Y | Y | Y | Y | Y | Y | Y |
| 21/126 | | Y | Y | Y | Y | Y | Y | Y |

*Y indicates that at least a portion of cutting oil contaminant is removed.
**
A is Al alloy 2024-T3 Bare/Anodized per MIL-C-5541
B is Al alloy 2024-T3 Bare/Anodized per MIL-A-8625
C is Al alloy 2024-T3 Clad/Anodized per MIL-C-5541
D is Al alloy 2024-T3 Clad/Anodized per MIL-A-8625
E is Al alloy 7075-T6 Clad/Anodized per MIL-C-5541
F is Al alloy 7075-T6 Clad/Anodized per MIL-A-8625
G is Al alloy 7075-T6 Bare/Anodized per BAC 5019

Examples 127-147

The ability of certain embodiments of the present solvent compositions and cleaning methods to effectively remove cutting oil in typical contaminant amounts found on metal parts used in the manufacture and/or repair and/or maintenance of such parts in connection with aircraft engines and/or other portions of the aircraft is illustrated by providing a coupon of each of the metal and metal alloys indicated in Table 8 contaminated as indicated herein. The contaminated coupon is contacted with each composition by immersing the coupon in each of the solvent compositions consisting of 1233zd as disclosed in Table 1 above and the results as reported in Table 8 below are achieved.

TABLE 8

| Comp./ Example ↓ | Material Tested* → | H** | I** | J** | K** | L** | M** | N** |
|---|---|---|---|---|---|---|---|---|
| 1/127 | | Y | Y | Y | Y | Y | Y | Y |
| 2/128 | | Y | Y | Y | Y | Y | Y | Y |
| 3/129 | | Y | Y | Y | Y | Y | Y | Y |
| 4/130 | | Y | Y | Y | Y | Y | Y | Y |
| 5/131 | | Y | Y | Y | Y | Y | Y | Y |
| 6/132 | | Y | Y | Y | Y | Y | Y | Y |
| 7/133 | | Y | Y | Y | Y | Y | Y | Y |
| 8/134 | | Y | Y | Y | Y | Y | Y | Y |
| 9/135 | | Y | Y | Y | Y | Y | Y | Y |
| 10/136 | | Y | Y | Y | Y | Y | Y | Y |
| 11/137 | | Y | Y | Y | Y | Y | Y | Y |
| 12/138 | | Y | Y | Y | Y | Y | Y | Y |
| 13/139 | | Y | Y | Y | Y | Y | Y | Y |
| 14/140 | | Y | Y | Y | Y | Y | Y | Y |
| 15/141 | | Y | Y | Y | Y | Y | Y | Y |
| 16/142 | | Y | Y | Y | Y | Y | Y | Y |
| 17/143 | | Y | Y | Y | Y | Y | Y | Y |
| 18/144 | | Y | Y | Y | Y | Y | Y | Y |
| 19/144 | | Y | Y | Y | Y | Y | Y | Y |

TABLE 8-continued

| Comp./ Example ↓ | Material Tested* → | H** | I** | J** | K** | L** | M** | N** |
|---|---|---|---|---|---|---|---|---|
| 20/146 | | Y | Y | Y | Y | Y | Y | Y |
| 21/147 | | Y | Y | Y | Y | Y | Y | Y |

*Y indicates at least a portion of cutting oil contaminant is removed.
**
H is Al alloy 7075-T6
I Al alloy 2024-T3
J is Titanium alloy 6A1-4V
K is Carbon Steel
L is Magnesium Alloy AZ31B-H24
M is 4130 Steel plated with low hydrogen embrittlement cadmium
N is Titanium

Example 148

Each of Examples 1-148 is repeated expect that the cleaning compositions comprise 2.5 wt % as a cosolvent of methanol and 97.5' % by weight of each of the 1233zd compositions described in Table 1. The results of all ASTM tests and solvent cleaning tests are acceptable.

Example 150

Each of Examples 1-148 is repeated expect that the cleaning compositions comprise 5 wt % as a cosolvent of methanol and 95' % by weight of each of the 1233zd compositions described in Table 1. The results of all ASTM tests and solvent cleaning tests are acceptable.

Example 151

Each of Examples 1-148 is repeated expect that the cleaning compositions comprises 7.5 wt % as a cosolvent of methanol and 92.5' % by weight of each of the 1233zd compositions described in Table 1. The results of all ASTM tests and solvent cleaning tests are acceptable.

Example 152

Each of Examples 1-148 is repeated expect that the cleaning compositions comprise 10 wt % as a cosolvent of methanol and 90' % by weight of each of the 1233zd compositions described in Table 1. The results of all ASTM tests and solvent cleaning tests are acceptable.

Example 153

Each of Examples 1-148 is repeated expect that the cleaning compositions comprise 2.5 wt % as a cosolvent of ethanol and 97.5' % by weight of each of the 1233zd compositions described in Table 1. The results of all ASTM tests and solvent cleaning tests are acceptable.

Example 154

Each of Examples 1-148 is repeated expect that the cleaning compositions comprise 5 wt % as a cosolvent of ethanol and 95' % by weight of each of the 1233zd compositions described in Table 1. The results of all ASTM tests and solvent cleaning tests are acceptable.

Example 155

Each of Examples 1-148 is repeated expect that the cleaning compositions comprise 7.5 wt % as a cosolvent of ethanol and 92.5' % by weight of each of the 1233zd compositions described in Table 1. The results of all ASTM tests and solvent cleaning tests are acceptable.

Example 156

Each of Examples 1-148 is repeated expect that the cleaning compositions comprise 10 wt % as a cosolvent of ethanol and 90'% by weight of each of the 1233zd compositions described in Table 1. The results of all ASTM tests and solvent cleaning tests are acceptable.

Example 157

Cleaning trials with electronics parts are conducted using an electronic board assembled using an RMA flux and having components containing gold on exposed surfaces thereof. The board is then completely immersed in each of the compositions identified in Table 1 for 10 min. The board is then removed and is visually inspected under 25× magnification. There is no visual corrosion of the gold contacts or delaminating of the assembly.

Example 158

Example 157 is repeated expect that the cleaning compositions comprise 5 wt % as a cosolvent of methanol and 95' % by weight of each of the 1233zd compositions described in Table 1. The results of all the solvent cleaning tests are acceptable.

Example 159

Example 157 is repeated expect that the cleaning composition comprises 10 wt % as a cosolvent of methanol and 90' % by weight of each of the 1233zd compositions described in Table 1. The results of all the solvent cleaning tests are acceptable.

Example 160

Example 157 is repeated expect that the cleaning composition comprises 5 wt % as a cosolvent of ethanol and 95' % by weight of each of the 1233zd compositions described in Table 1. The results of all the solvent cleaning tests are acceptable.

Example 161

Example 157 is repeated expect that the cleaning composition comprises 10 wt % as a cosolvent of ethanol and 95' % by weight of each of the 1233zd compositions described in Table 1. The results of all the solvent cleaning tests are acceptable.

Example 162

Cleaning trials with electronics parts are conducted using an electronic board assembled using an RMA flux and have components containing gold on exposed surfaces thereof. The board was then completely immersed in each of a the compositions identified in mixture of 4 wt % methanol and 96 wt % trans-1233zd for 10 min. The board was then removed and was visually inspected under 25× magnification. There was no visual corrosion of the gold contacts or delaminating of the assembly.

Having thus described a few particular embodiments of the invention, various alterations, modifications, and improvements will readily occur to those skilled in the art. Such alterations, modifications, and improvements, as are made obvious by this disclosure, are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A method of cleaning metal parts to be used in an aircraft comprising:

a. providing a solvent composition comprising at least about 50% by weight of 1-chloro-3,3,3-trifluoropropene (1233zd): and b. contacting the metal part to be used in an aircraft with said solvent composition, said metal part comprising a metal or a metal alloy selected from titanium and titanium alloys; zinc and zinc alloys; tungsten and tungsten alloys; copper and copper alloys; Inconel-Ni alloys; cadmium and cadmium alloys; stainless steels; gold and gold alloys; and silver and silver alloys.

2. The method of claim 1 wherein said contacting step comprises spraying said metal part with said solvent composition.

3. The method of claim 1 wherein said contacting step comprises immersing said metal part in said solvent composition.

4. The method of claim 1 wherein said solvent composition is in a liquid phase during said immersing step.

5. The method of claim 1 wherein said solvent composition is in a vapor phase during said immersing step.

6. The method of claim 1 wherein said metal part comprises a metal or a metal alloy selected from tungsten carbide, silver braze alloys, and 440C stainless steel.

7. The method of claim 1 wherein said metal part comprises a cadmium plated components or part.

8. The method of claim 2 wherein said solvent composition further comprises methanol.

9. The method of claim 2 wherein said solvent composition further comprises ethanol.

10. The method of claim 8 wherein said ethanol is present in the composition in an amount of from about one to about 10% by weight of the composition.

11. The method of claim 8 wherein said ethanol is present in the composition in an amount of from about one to about 5% by weight of the composition.

12. The method of claim 1 wherein said metal part is contaminated with cutting oil prior to said contacting step.

13. The method of claim 8 wherein said methanol is present in the composition in an amount of from about one to about 10% by weight of the composition.

14. The method of claim 8 wherein said methanol is present in the composition in an amount of from about one to about 5% by weight of the composition.

15. The method of claim 12 wherein at least a portion of said cutting oil is removed by said contacting step.

16. A method of repairing or maintaining an aircraft engine containing metal parts, said method comprising cleaning a metal part of the aircraft engine by steps that include contacting the metal part with a solvent composition comprising at least about 50% by weight of 1-chloro-3,3,3-trifluoropropene (1233zd), said metal part comprising a metal or a metal alloy selected from titanium and titanium alloys; zinc and zinc alloys; tungsten and tungsten alloys;

copper and copper alloys; Inconel-Ni alloys; cadmium and cadmium alloys; stainless steels; gold and gold alloys; and silver and silver alloys.

17. The method of claim 1 wherein said solvent composition consists essentially of 1-chloro-3,3,3-trifluoropropene (1233zd).

18. The method of claim 1 wherein said solvent composition consists essentially of trans1-chloro-3,3,3-trifluoropropene (1233zd).

* * * * *